US006179721B1

(12) United States Patent
Bevan

(10) Patent No.: US 6,179,721 B1
(45) **Date of Patent: *Jan. 30, 2001**

(54) GOLF PUTTING APPARATUS WITH VARIABLE SURFACE

(76) Inventor: Paul C. Bevan, 115 Signature Dr., Melbourne Beach, FL (US) 32951

( * ) Notice: Under 35 U.S.C. 154(b), the term of this patent shall be extended for 0 days.

This patent is subject to a terminal disclaimer.

(21) Appl. No.: 09/273,924

(22) Filed: Mar. 22, 1999

(51) Int. Cl.[7] ..... A63B 69/36
(52) U.S. Cl. ..... 473/160; 473/171
(58) Field of Search ..... 473/160, 161, 473/162, 157–159, 163, 171

(56) References Cited

U.S. PATENT DOCUMENTS

| | | | | |
|---|---|---|---|---|
| 1,582,183 | | 4/1926 | Maurer . | |
| 1,612,291 | | 12/1926 | Jackson . | |
| 1,662,864 | | 4/1928 | Peterson . | |
| 1,761,039 | | 6/1930 | Hazeltine . | |
| 2,014,992 | * | 9/1935 | Stayton | 473/162 |
| 2,118,084 | | 5/1938 | Heinzelmann | 273/87 |
| 2,334,540 | | 11/1943 | Buffham | 273/35 |
| 2,678,823 | | 5/1954 | Hugman | 273/35 |
| 3,170,694 | | 2/1965 | Dolce | 273/115 |
| 3,366,388 | | 1/1968 | Del Roso | 273/176 |
| 3,508,756 | | 4/1970 | Bedford, Jr. | 273/176 |
| 3,522,947 | | 8/1970 | Anderson et al. | 273/176 |
| 3,549,151 | | 12/1970 | Long | 273/178 |
| 3,595,581 | | 7/1971 | Anderson | 273/176 H |
| 3,601,407 | | 8/1971 | Lorrance | 273/176 H |
| 3,658,343 | | 4/1972 | Rogers et al. | 273/176 H |
| 3,690,673 | | 9/1972 | Occhipinti | 273/176 H |
| 3,727,917 | | 4/1973 | MacLean | 273/176 H |
| 3,762,718 | | 10/1973 | Culley | 273/176 H |
| 3,871,661 | | 3/1975 | Korff | 273/178 B |
| 3,892,412 | | 7/1975 | Koo | 273/176 H |
| 3,909,006 | | 9/1975 | Arbaugh | 273/176 AA |
| 3,944,232 | | 3/1976 | Tierney | 273/176 FB |
| 4,211,417 | | 7/1980 | Brown | 273/176 H |
| 4,222,568 | | 9/1980 | Russo | 273/176 H |
| 4,240,637 | | 12/1980 | Cross et al. | 273/176 H |
| 4,247,112 | | 1/1981 | Del Raso | 273/176 H |
| 4,596,391 | | 6/1986 | Carolan, Jr. | 273/176 B |
| 4,611,809 | | 9/1986 | Gettelfinger | 273/176 H |
| 4,743,027 | | 5/1988 | Simjian | 273/178 R |
| 4,790,538 | | 12/1988 | Gettelfinger | 273/176 H |
| 4,988,106 | | 1/1991 | Coonrod | 273/176 F |
| 5,002,280 | | 3/1991 | Hines | 273/176 FB |
| 5,087,045 | | 2/1992 | Kim | 273/176 H |
| 5,102,141 | | 4/1992 | Jordan | 273/182 R |
| 5,172,914 | | 12/1992 | Primerano | 273/176 H |
| 5,213,325 | | 5/1993 | Malavazos et al. | 273/110 |
| 5,318,303 | | 6/1994 | Kim | 273/176 H |
| 5,431,403 | | 7/1995 | Pelz | 273/178 B |
| 5,445,381 | | 8/1995 | Van Ert | 273/176 H |
| 5,855,522 | * | 9/1935 | Bevan | 473/160 |

* cited by examiner

*Primary Examiner*—Mark S. Graham
(74) *Attorney, Agent, or Firm*—Nields & Lemack

(57) ABSTRACT

Golf putting apparatus having a putting surface on which a plurality of support springs and corresponding connecting members are provided proximate the periphery of the putting surface for enabling the user to quickly and easily create, or selectively alter, undulations in the putting surface to simulate actual putting conditions.

5 Claims, 3 Drawing Sheets

GOLF PUTTING APPARATUS WITH VARIABLE SURFACE

FIELD OF THE INVENTION

This invention relates to golf putting devices having a surface which can be selectively altered by the user to create undulations or variable breaking speeds in the surface.

BACKGROUND OF THE INVENTION

Golf putting devices having a selectively variable surface are well known. Numerous kinds of means for selectively varying the surface of these devices have been developed over the years. For example, U.S. Pat. No. 1,761,039 issued to Hazeltine and U.S. Pat. No. 3,727,917 issued to MacLean disclose variable contour golf putting devices with hinged panels and pegs for propping up various sections of the putting surface at the hinge joints; U.S. Pat. No. 3,690,673 issued to Occhipinti and U.S. Pat. No. 3,892,412 issued to Koo disclose variable contour golf putting devices with inflatable air sacs disposed at various locations under the putting surface; U.S. Pat. No. 1,582,183 issued to Maurer, U.S. Pat. No. 3,170,694 issued to Dolce, U.S. Pat. No. 4,222,568 issued to Russo and U.S. Pat. No. 4,790,538 issued to Gettelfinger disclose variable putting surfaces using a variety of gears, shafts, cams and levers to distort the putting surface; U.S. Pat. No. 3,595,581 issued to Andersen, U.S. Pat. No. 3,658,343 issued to Rogers and U.S. Pat. No. 4,247,112 issued to Del Raso disclose variable putting surfaces using a series of jacks to prop up various sections of the putting surface; U.S. Pat. No. 2,118,084 issued to Heinzelmann, U.S. Pat. No. 2,334,540 issued to Buffham, U.S. Pat. No. 3,601,407 issued to Lorrance, U.S. Pat. No. 4,743,027 issued to Simjian, U.S. Pat. No. 5,002,280 issued to Hines and U.S. Pat. No. 5,172,914 issued to Primerano disclose variable putting surfaces which use a variety of levers and rods to push up on the underside of the putting surfaces; U.S. Pat. No. 3,871,661 issued to Korff which discloses a kidney shaped putting green under which an angled panel is swiveled to raise portions of the putting green; and U.S. Pat. No. 4,240,637 issued to Cross which discloses a coin operated putting apparatus which is tilted using a crank shaft which communicates with a threaded bolt around which a nut affixed to the putting surface is rotated thus increasing or decreasing the elevation of the putting surface. However, these designs for varying the contour of the putting surface are unwieldy, require numerous interlocking parts and are costly to manufacture and assemble. In contrast, there are a few relatively simple designs which are known. For example, U.S. Pat. No. 5,318,303 issued to Kim discloses a hinged putting surface and a canopy from which strings with hooks are hung to selectively engage and hold up the panels; U.S. Pat. No. 3,508,756 issued to Bedford discloses a flexible horizontal putting surface, suspended by loops under tension between vertical arms, which is contoured by raising and lowering the loops on the arms causing the surface to torque; and U.S. Pat. No. 4,211,417 issued to Brown and U.S. Pat. No. 4,988,106 issued to Coonrod disclose a putting surface which is contoured by pushing a wedge-shaped device under the bottom of the putting surface. However, these simplistic designs do not provide the user with potential surface variations adequate to recreate actual putting conditions encountered on the golfing green.

U.S. Pat. No. 5,855,522, the disclosure of which is hereby incorporated by reference, discloses a variable golf putting surface which the present invention improves over.

SUMMARY OF THE INVENTION

Therefore it is an object of the invention to provide a golf putting device with a selectively variable contoured surface that is inexpensive to manufacture.

It is a further object of the invention to provide a golf putting device with a selectively variable contoured surface that can be adjusted quickly and easily.

It is a further object of the invention to provide a golf putting device with a selectively variable contoured surface capable of fine adjustment.

It is a further object of the invention to provide a golf putting device which is lightweight.

The preferred embodiment of the invention features a golf putting device having a selectively contourable putting surface over which a golf ball is putted towards a hole, comprising: a plurality of helical springs having an outside diameter; a flexible panel supported by said springs, the panel comprising a periphery, a plurality of panel bores having a diameter smaller than the diameter of the springs and provided proximate the periphery, and hole having a diameter larger than the golf ball; a plurality of receiving members; a plurality of connecting members adapted to be inserted into the receiving members, the receiving members being provided first through one panel bore then through one support spring and then into one receiving member, compression and rotation of any connecting member causing a change in the compressed state of its associated spring, which change causes variations in the relative height of the surface of the flexible panel. The bores in the panel are of a larger dimension than the penetrating connecting members, allowing lateral and longitudinal movement of the panel with respect to the connecting member as the panel contour is modified.

The golf putting device may further feature a flexible panel which is reversible and further comprises a top surface having a top surface speed and a bottom surface having a bottom surface speed that is faster or slower than the top surface speed. The flexible panel may also include an extension panel removably fixed to the flexible panel or foldable with respect thereto to selectively vary the overall length of the flexible panel.

The connecting members of the preferred embodiment may be threaded, ratcheted or keyed.

This invention is the result of efforts to design a golf putting device with a selectively variable contoured surface that is cost effective to make and has an adjusting mechanism that is quickly and easily manipulated by the user.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE INVENTION

This invention features a simple golf putting device having a plurality of support springs and corresponding connecting members, provided proximate the periphery of the putting surface, which can be quickly and easily adjusted to create a variable undulating golf putting surface.

Figure 1:
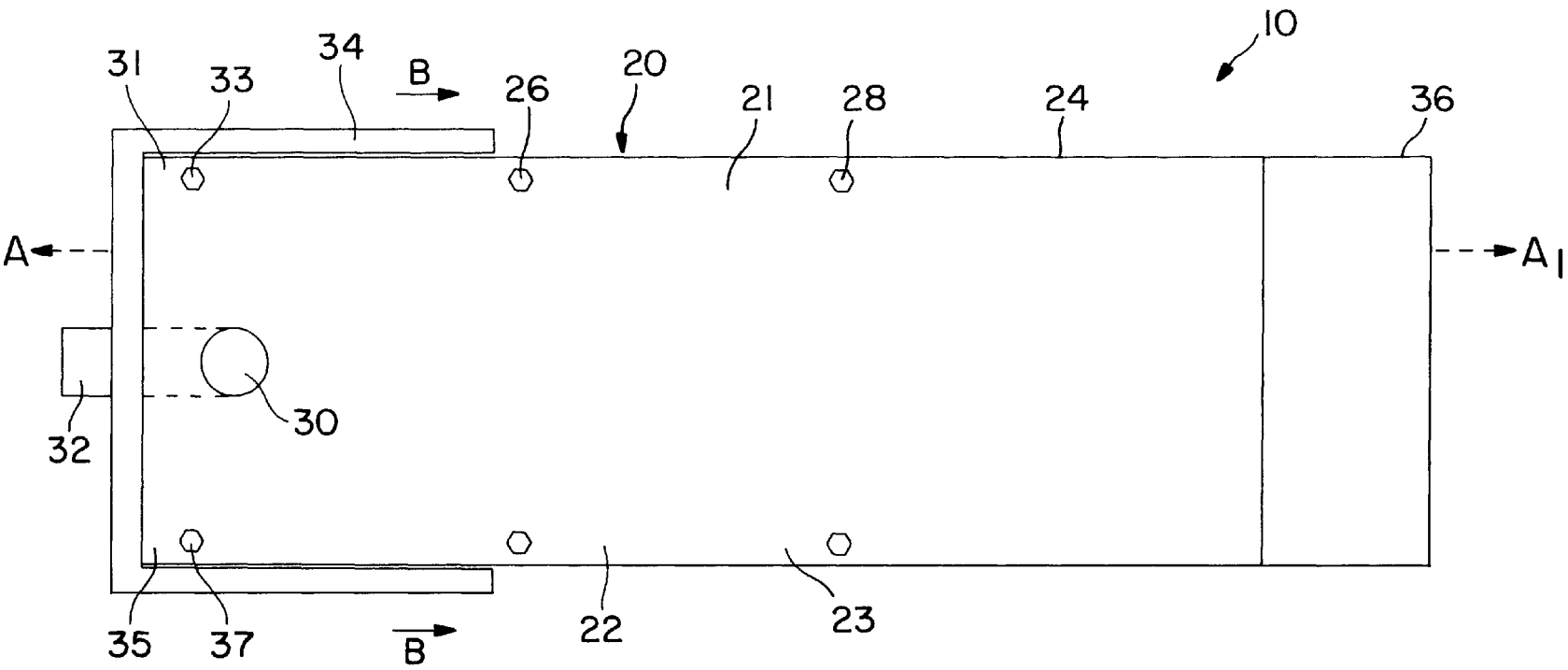
FIG. 1 is a top view of the present invention.
Figure 2:
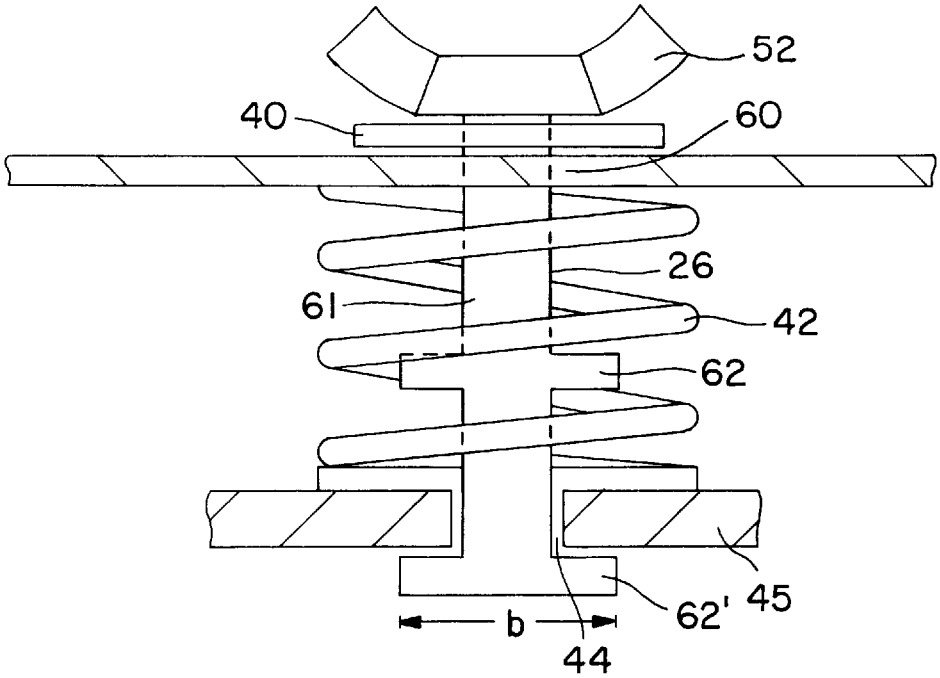
FIG. 2 is a partial side view of the present invention with the putting surface in a first position.

A preferred embodiment is shown in FIGS. 1 and 2 as golf device 10. A plurality of receiving apertures 44, preferably six, are provided in base portion or substrate 45. Support springs, such as helical spring 42, have an inside dimension greater than the dimension of the receiving apertures 44, and greater than the diameter of bores 60 provided in panel 24, are positioned around the apertures 44. The springs 42 in their uncompressed state provide a first position of a flexible support system for panel 24. Panel 24 is placed so that bores 60 on the periphery of said panel align vertically with the receiving apertures 44. Connecting members 26, 28, 33, 37, or the like insert into the matching receiving apertures 44.

Figure 2A:
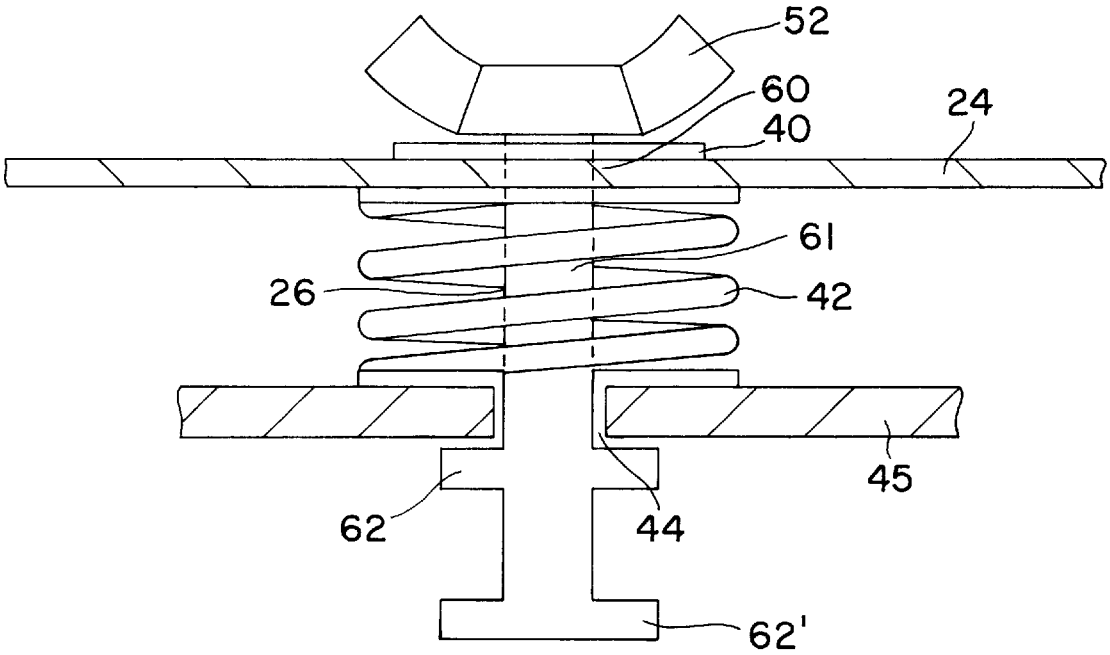
FIG. 2A a partial side view of the present invention with the putting surface in a second position.

In the embodiment shown, each connecting member includes an elongated longitudinal leg portion 61 having at least two spaced wings 62, 62' extending laterally from the elongated portion 61. It is preferred that the wings 62, 62' extend perpendicularly to the elongated portion 61 as shown, although angles less than or greater than 90° can be functional. Each wing is dimensioned such that it fits through receiving aperture 44 in only one direction. For example, each wing can have a dimension "a" (FIGS. 3 and 3A) that corresponds to the diameter of the elongated portion 61, and that is smaller than the width of the receiving aperture 44. Similarly, each wing can have a dimension "b" that is greater than the width of the receiving aperture 44. Thus, appropriate rotation of the connecting member 26 allows for one or more of the wings to be inserted through receiving aperture 44, and further rotation of the connecting member causes the wing to engage the under-surface of base portion 45, locking the connecting member in place and preventing further vertical movement thereof until further rotation unlocks the assembly. Thus, as shown in FIG. 2A, downward pressure on the connecting members compress the spring 42, rotation of the connecting members causes the wing 62' to engage the sides of base portion 45 about the aperture 44, locking the spring and putting surface in a lower second position. The head of each connecting member, which can instead be a wingnut 52 or other similar capping device, is larger in diameter than the panel bore so that the head sits on the surface of the panel 24. Alternatively or in addition, washers 40 or the like can be used having diameters larger than the panel bore diameter to ensure that the head of the connecting member remains atop the surface of the panel 24. The elongated portion 61 of each connecting member is smaller than each panel bore 60 in order to allow both lateral and longitudinal movement of the panel 24 about the elongated portion 61 during manipulation of the panel contour in accordance with the present invention. The difference in height between uncompressed support springs 42 in FIG. 2 and compressed springs 42 in FIG. 2A determines the degree of panel surface variability achievable. Lowering or raising the connecting members the minimum connecting member length between the first and second positions should equal the spring compression plus the thickness of the panel 24 and any concomitant putting surface thereon.

Those skilled in the art will appreciate that each connecting member can have more than two spaced wings in order to achieve additional variation of the panel 24 slope.

By using a plurality of spring/connecting member assemblies on opposite lateral sides of the panel 24, several advantages can be achieved. For example, the slope of the panel 24 or putting surface thereon can be varied both in the longitudinal direction (i.e., as between the golf hole 30 and the opposite end of the panel 24 from which the putter is positioned) between connecting members located on the same side of the panel 24 (i.e., between connecting members 33 and 26 an d 26 and 28), and in the lateral direction, between connecting members oppositely located (e.g., between connecting members 33 and 37). For example, by lowering connecting member 33 relative to connecting member 26, a longitudinal slope of panel 24 downwardly in the direction of the golf hole 30 can be achieved. Similarly, by lowering connecting member 33 relative to connecting member 37, a lateral slope of panel 24 downwardly towards connecting member 33 can be achieved. From the foregoing, it immediately becomes apparent that numerous putting surface contours can be easily achieved, simulating actual putting conditions. As the number of connecting member/spring assemblies on each side of panel 24 is increased, the more undulations can be created per length of panel 24. Although it is preferred that the connecting member/spring assemblies be located such that each connecting member/spring assembly on one lateral side of the panel 24 has a connecting member/spring assembly directly opposite on the opposing lateral side of the panel 24, it is within the scope of the present invention to offset the opposing connecting member/spring assemblies.

Preferably the bores in the panel 24 extend more than half way from the end of panel 24 proximate the hole 30 to the opposite putting end of panel 24, thereby enabling the optimum spacing among the plurality of screw/spring assemblies. Panel 24 is a flexible board preferably made from semi-rigid Georgia Pacific ⅛" pressed hardboard. Other materials may be used to make panel 24 provided these materials comport with the objects of the invention. In particular, the panel 24 should be rigid enough so as to maintain the undulations created between lateral and opposing screw/spring assemblies, but flexible enough so that such undulations can be created. Too rigid a board will not allow sufficient differences in relative height between both laterally spaced and opposing screw/spring assemblies to be achieved. The top or putting side of panel 24 is preferably covered with a surface material having a nap resembling the surface conditions of a typical putting green. The preferred surface material is a 24 oz. olefin polypropylene indoor/outdoor carpet made by General Felt Industries and is fixed to panel 24 using a suitable adhesive. To make a reversible panel 24, the bottom side of panel 24 is covered with a surface material having a nap that is substantially shorter or longer than the surface material covering the top side of panel 24 to create a surface having a surface speed which is faster or slower, respectively, than the surface speed of General Felt's 24 oz. olefin polypropylene carpet. For example, billiard felt will provide a faster surface speed than the 24 oz. olefin polypropylene carpet.

Golf device 10 is shown with optional extender panel 36 which can be removably or foldably attached to the end of panel 24 by clasp or hinge 38 so as to create a substantially smooth surface joint between extender panel 36 and panel 24. Removable or foldable extender panel 36 allows for a longer putting surface but maintains the compactness of the apparatus for easy storage and transport. Golf hole 30 is provided in panel 24, preferably centrally located in the lateral direction and at or near the end of panel 24 remote from the putter as shown in FIG. 1. Where space permits, golf hole 30 preferably opens into ball receptacle 32 for receiving and retaining golf balls which drop into golf hole 30. Golf hole 30 must have a diameter larger than a typical golf ball and preferably has a diameter substantially the same as the standard diameter established for holes on professional golf course. Optional ball gutter 34 surrounds that portion of panel 24's periphery which is proximate golf hole 30. Ball gutter 34 can stand alone or be fixed to panel 24. Ball gutter 34 should be fixed in such a way to panel 24, or have a shape, so as to cause a golf ball, which drops into ball gutter 34, to roll in the direction of arrows B back towards the user. Ball return devices such as ball gutter 34 are well known in the art of golf putting devices and as such someone skilled in the relevant art will readily understand how to make and attach such a device to panel 24. Ball receptacle 32 may be configured to direct golf balls, which drop into golf hole 30, into ball gutter 34.

Figure 3:
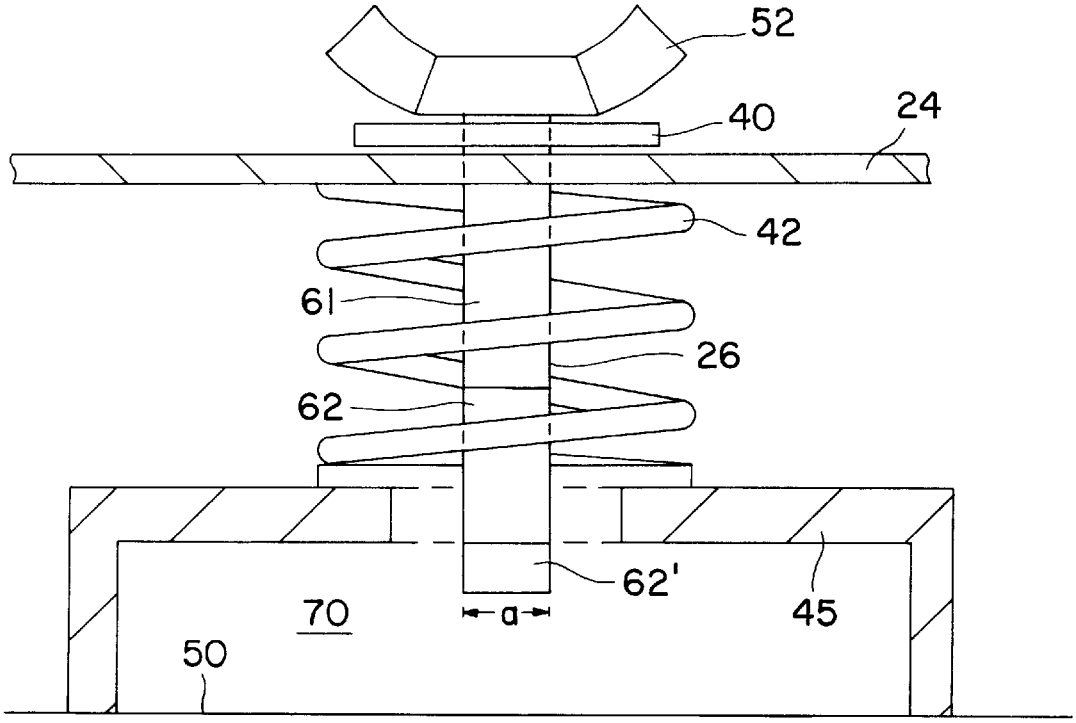
FIG. 3 is a partial end view of the invention with the putting surface in a first position.
Figure 3A:
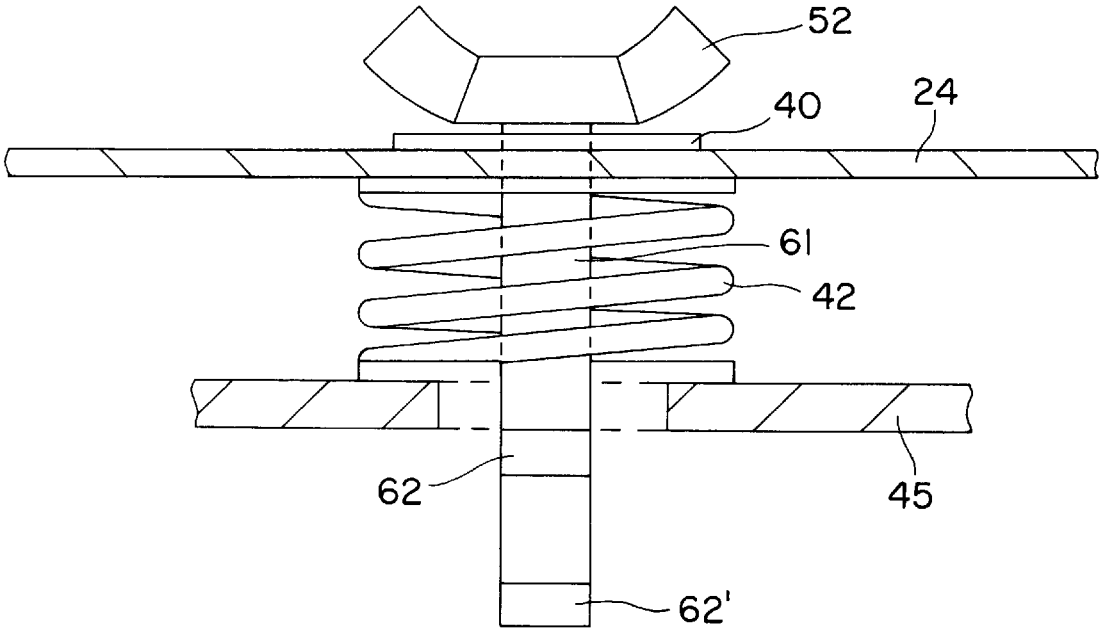
FIG. 3A a partial end view of the invention with the putting surface in a second position.

FIGS. 2 and 2A are enlarged views of connecting members 26 and 28 assembled together with their corresponding washers, springs and receiving apertures. FIG. 2 shows connecting member 26 engaging aperture 44 so that helical spring 42 is in a non-compressed position, causing the panel 24 to be in a raised position. FIG. 2A shows the connecting member 28 engaging the aperture 44 with in a second locking position, causing compression of spring 42 and lowering of panel 24. The apertures 44 are formed in a base portion 45 that rests on a substrate 50, such as a floor. The base portion 45 can be elevated from the substrate as shown in FIG. 3, thereby defining a space 70 into which the connecting member can be inserted. Alternatively, the base portion 45 can be the substrate or floor.

When the connecting member/spring/receiving aperture joint is assembled, total height of the extended connecting member will equal the height of the spring. The difference between the height of the fully extended and fully compressed spring will determine the extent to which the elevation of panel 24 may be increased or decreased at the point of a given aperture 44. By raising and lowering any connecting member engaging the periphery of panel 24, the elevation of panel 24 can be altered to create varying undulations in panel 24 to recreate the undulating contours encountered on a golf green. By virtue of the connecting member/aperture/spring arrangement, the elevation of panel 24 can be finely adjusted to recreate even the subtle but difficult variations found on golf courses.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. Golf putting apparatus for putting a golf ball, comprising:

a substrate having a plurality of apertures;

a plurality of springs, each of said plurality of springs being disposed about one of said plurality of apertures;

a plurality of connecting members, each of said connecting members comprising an elongated portion and at least two spaced projections; and a flexible panel defining said putting surface, said flexible panel being supported on said plurality of springs and movably coupled to said substrate by said plurality of connecting members, said flexible panel having a hole having a diameter larger than a golf ball, wherein said plurality of connecting members secure said flexible panel to said substrate above said plurality of springs.

2. The golf putting device of claim 1, wherein said plurality of apertures each have a width, and wherein said spaced projections having a dimension larger than said width.

3. The golf putting device of claim 1, wherein said flexible panel is reversible and further comprises a top having a surface adapted to impart a first frictional force on a rolling ball and a bottom having a surface adapted to impart a second frictional force on a rolling ball, said second frictional force being different from said first frictional force.

4. The golf putting device of claim 1 wherein said hole further comprises a receptacle for receiving and retaining said golf ball therein.

5. Adjustable golf putting surface apparatus, comprising:

a putting surface defined by a first end and a second end spaced from said first end and a pair of opposite sides extending between said first and second ends, each of said opposite sides having a plurality of bores;

an aperture formed in said surface at a point remote from said first end;

a plurality of connecting members, each of said plurality of connecting members being positioned through one of said plurality of bores in said opposite sides of said putting surface, each of said plurality of connecting members comprising a plurality of spaced wings extending laterally from said connecting members;

a plurality of springs, each said spring being positioned about one of said plurality of connecting members; and a substrate having a plurality of apertures for receiving a respective connecting member, said substrate having a top surface and a bottom surface opposite said top surface, whereby rotation of a connecting member allows insertion of said connecting member into a respective aperture of said substrate, and further rotation of said connecting member causes one of said plurality of wings thereon to engage said bottom surface of said substrate against the bias of one of said plurality of springs to lock said connecting member with respect to said substrate.

* * * * *